US007387173B2

(12) United States Patent
Jinnings et al.

(10) Patent No.: US 7,387,173 B2
(45) Date of Patent: Jun. 17, 2008

(54) PILE DRIVER

(75) Inventors: John Jinnings, Leo, IN (US); Mark Gustin, Harlan, IN (US)

(73) Assignee: Innovative Pile Driving Products, LLC, Fort Wayne, IN (US)

( * ) Notice: Subject to any disclaimer, the term of this patent is extended or adjusted under 35 U.S.C. 154(b) by 20 days.

(21) Appl. No.: 11/369,462

(22) Filed: Mar. 7, 2006

(65) Prior Publication Data

US 2006/0213676 A1 Sep. 28, 2006

Related U.S. Application Data

(60) Provisional application No. 60/659,711, filed on Mar. 8, 2005, provisional application No. 60/661,104, filed on Mar. 11, 2005.

(51) Int. Cl.
*E21B 3/02* (2006.01)

(52) U.S. Cl. ..... 173/184; 173/42; 173/44; 173/89; 173/147; 173/152

(58) Field of Classification Search ..... 173/28, 173/184, 42, 44, 128, 198, 199, 189, 29, 173/147, 152, 218, 185, 89
See application file for complete search history.

(56) References Cited

U.S. PATENT DOCUMENTS

| | | | | |
|---|---|---|---|---|
| 2,805,847 A | | 9/1957 | Malloy | 262/15 |
| 2,903,949 A | * | 9/1959 | Simmonds | 173/194 |
| 2,940,267 A | * | 6/1960 | Shaver | 173/46 |
| 3,086,600 A | | 4/1963 | Kerley, Jr. | 175/155 |
| 3,216,511 A | * | 11/1965 | Ladd et al. | 173/19 |
| 3,333,646 A | * | 8/1967 | Hoen et al. | 173/27 |
| 3,400,771 A | * | 9/1968 | Dorn | 173/195 |
| 3,566,977 A | | 3/1971 | Wandell | 173/90 |
| 3,809,344 A | * | 5/1974 | Kolderup et al. | 173/185 |
| 3,934,656 A | | 1/1976 | Pappert | 173/124 |
| 3,961,672 A | * | 6/1976 | Welsch et al. | 173/193 |
| 4,099,579 A | * | 7/1978 | Stormon | 173/4 |
| 4,124,081 A | | 11/1978 | Deike | 173/28 |
| 4,366,870 A | | 1/1983 | Frederick | 173/131 |
| 4,465,145 A | | 8/1984 | Kuhn | 173/131 |
| 4,506,744 A | | 3/1985 | Dawson | 173/131 |
| 4,989,677 A | | 2/1991 | Lam | 173/31 |
| 5,088,567 A | | 2/1992 | Schnell et al. | 173/122 |
| 5,282,511 A | | 2/1994 | Burenga et al. | 173/184 |
| 5,375,664 A | * | 12/1994 | McDowell et al. | 173/1 |
| 5,638,911 A | * | 6/1997 | Beechwood et al. | 175/162 |
| 6,061,933 A | | 5/2000 | Rogge | 37/403 |

(Continued)

*Primary Examiner*—Scott A Smith
(74) *Attorney, Agent, or Firm*—Baker & Daniels LLP

(57) ABSTRACT

A pile driver including an apparatus for allowing relative movement between a hammer and a boom of an excavator. The apparatus includes a mounting plate mounted to the boom that interfits with and is slidable with respect to a frame rail mounted to the hammer. In operation, the hammer is placed on top of a pile and, as the pile is driven downwardly, the hammer follows the pile. Owing to the relative movement between the boom of the excavator and the hammer, the hammer follows the pile without requiring continuous downward readjustment of the boom. In one embodiment, the mounting plate assembly does not extend substantially above the hammer frame. In another embodiment, the hammer can rotate with respect to the boom. In one embodiment, the hammer includes a ram, a cylinder for lifting the ram, and rotation-resistant cable connecting the ram and the cylinder.

11 Claims, 11 Drawing Sheets

U.S. PATENT DOCUMENTS 6,305,480 B1 10/2001 Franklin ..... 173/27
6,557,647 B2 5/2003 White ..... 173/17
6,796,747 B1 * 9/2004 Vreeland ..... 405/302.7
6,896,072 B2 * 5/2005 MacDonald ..... 173/192
7,100,709 B2 * 9/2006 Bowe et al. ..... 175/113
2003/0121219 A1 7/2003 Dietel ..... 52/163

* cited by examiner

PILE DRIVER

CROSS REFERENCE TO RELATED APPLICATIONS

This application claims the benefit under 35 U.S.C. §119 (e) of U.S. Provisional Patent Application Ser. No. 60/659,711, entitled PILE DRIVER, filed on Mar. 8, 2005 and U.S. Provisional Patent Application Ser. No. 60/661,104, entitled PILE DRIVER, filed on Mar. 11, 2005, the entire disclosures of which are hereby expressly incorporated by reference herein.

BACKGROUND OF THE INVENTION

1. Field of the Invention

The present invention relates to pile drivers, particularly with regard to reciprocating pile drivers.

2. Description of the Related Art

Pile drivers are used to drive piles, such as beams, columns or supports, e.g., into the ground. Reciprocating pile drivers include a hammer that is placed onto the head, or top, of the pile by a hoist or a boom of, e.g., an excavator. The hammer typically includes a frame and a large ram, or weight, that is raised within the frame and then dropped onto the pile head. This process is repeated until the pile is driven into the ground to a desired depth. Commonly, a pneumatic or hydraulic cylinder is mounted to the frame to raise and then release the ram. However, in existing hammers, as the ram strikes the pile, significant forces are transmitted into the cylinder through a cylinder rod attached to the ram. As a result, these cylinders frequently break resulting in significant downtime and cost to replace the cylinder. Some existing hammers include a nylon or rubber mount at the connection between the ram and cylinder rod to dampen these forces, however, these mounts can deteriorate quickly.

As the pile is driven downwardly, the hammer frame is typically positioned on top of the pile or a drive cap positioned on top of the pile. If the frame does not rest on top of the pile or drive cap, the ram may strike the frame instead of the pile thereby transmitting the force of the falling ram into the frame. This force may be transferred from the frame into the boom of an excavator, e.g., causing damage to the excavator and possibly causing the excavator to tip over. Some previous hammers had to be lowered after each strike of the ram to keep the hammer frame in contact with the pile head. Other hammers were lowered within a large, elongate outer frame to keep the hammer frame in contact with the pile head. However, these outer frames required significant overhead room to position the hammer, thus, pile drivers utilizing these outer frames were mostly limited to outdoor applications.

What is needed is an improvement over the foregoing.

SUMMARY OF THE INVENTION

One aspect of the invention includes a mounting apparatus for connecting a ram lifting mechanism to a ram of a hammer. In one embodiment, the mounting apparatus includes a connector member that is connected to the ram and a cable extending between the connector member and a cylinder rod extending from a cylinder. In operation, the cable is drawn taut as the cylinder raises the ram, however, the cable is permitted to flex or deform when the ram strikes the pile. Thus, very little of the force created by the ram impacting the pile is transmitted into the cylinder. In one embodiment, the connector member includes a flange that is captured between the ram and a retaining cap that is fastened to the ram.

Another form of the invention includes an apparatus for allowing relative movement between the hammer and, e.g., the boom of an excavator. In one embodiment, the apparatus includes at least one frame rail mounted to the hammer frame and a mounting plate assembly that interfits with and is slidable with respect to the frame rail mounted to the boom of an excavator. In one embodiment, the mounting plate assembly includes a recess that envelops the frame rail. In an alternative embodiment, the mounting plate assembly is enveloped by the frame rail. In the present embodiment, the mounting plate assembly interfits with the frame rail in such a way that the mounting plate assembly can slide along an axis defined by the rail. The mounting plate assembly can be further constructed to prevent substantial relative movement between the hammer and the mounting plate assembly transverse to the rail axis. In a further embodiment, the apparatus can permit relative rotational movement between the hammer and the boom of an excavator. This embodiment may be helpful when the excavator is sitting on an inclined surface.

In operation, in one form of the invention, the hammer is placed on top of the pile and, as the pile is driven downwardly, the hammer follows the pile owing to the relative movement between the excavator boom and the hammer. Advantageously, the hammer can follow the pile without requiring continuous downward readjustment of the boom. However, the boom is adjusted periodically when the mounting plate reaches an end of the hammer frame rail. As a result, the possibility of operator error is reduced as fewer adjustments of the boom are required. Further, pile drivers incorporating this apparatus are an improvement over existing pile drivers as the possibility of the ram striking the frame is also reduced. In one embodiment, the mounting plate assembly does not extend substantially above the hammer frame. This embodiment provides an added advantage of allowing the hammer to be used inside buildings, etc, having very little overhead room.

BRIEF DESCRIPTION OF THE DRAWINGS

The above-mentioned and other features and advantages of this invention, and the manner of attaining them, will become more apparent and the invention itself will be better understood by reference to the following descriptions of embodiments of the invention taken in conjunction with the accompanying drawings, wherein.

Figure 1:
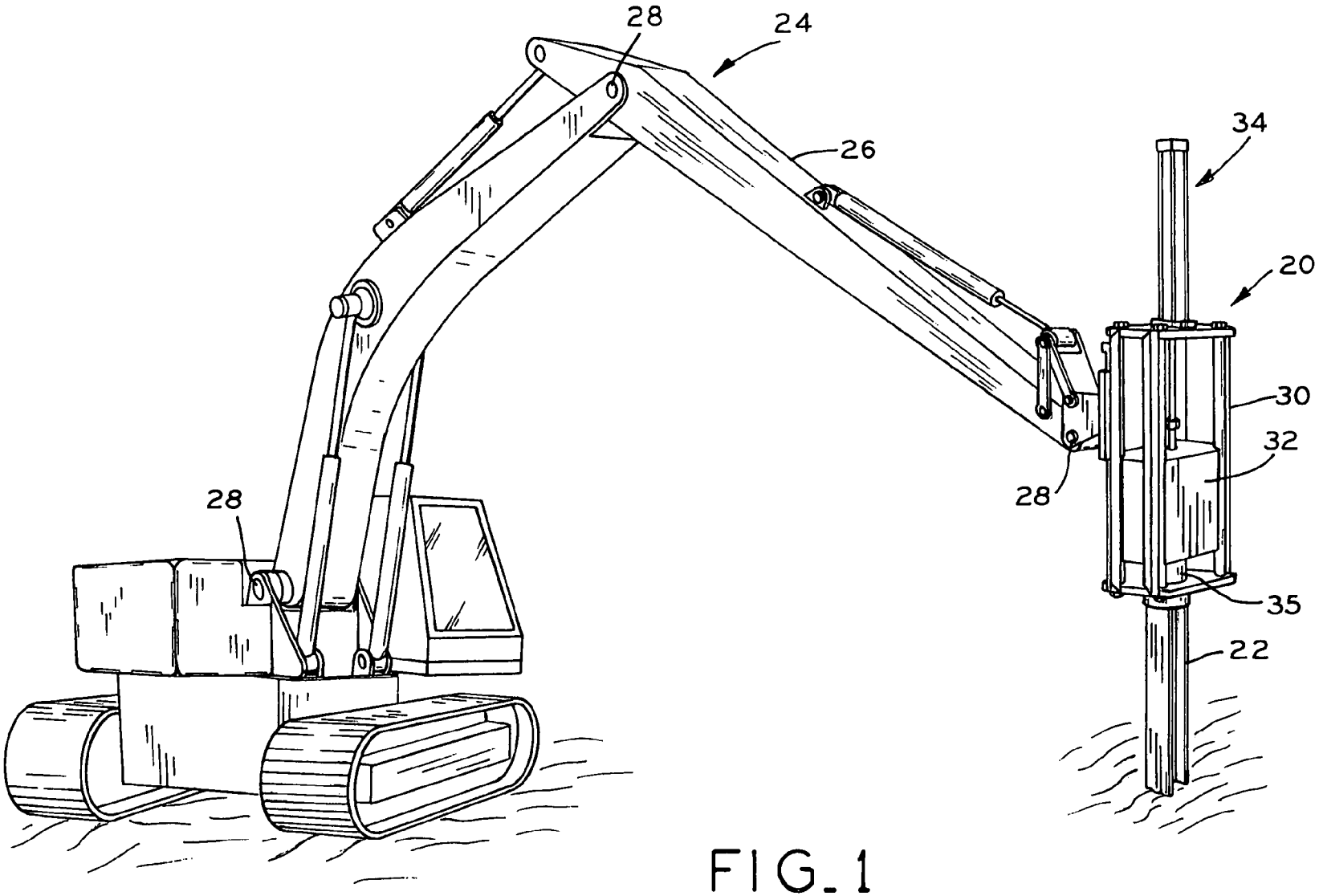
FIG. 1 is a perspective view of a hammer in accordance with the present invention positioned on top of a pile by an excavator boom.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION

As illustrated in FIG. 1, hammer 20, in operation, is placed on top of pile 22 by excavator 24. Excavator 24 includes boom 26 that articulates at several joints 28, as is well known in the art, to position hammer 20. In the present embodiment, hammer 20 includes frame 30, ram 32 positioned within frame 30, and a ram lifting mechanism in the form of cylinder assembly 34 mounted to the top of frame 30. In operation, ram 32 is raised by hydraulic or pneumatic cylinder assembly 34 and then dropped onto pile 22. Commonly, a drive cap (not illustrated) is placed over the end of the pile to reduce deformation, or mushrooming, of the top of the pile. The drive cap includes a substantially flat upper surface and a recess in a bottom surface that mates with the top of the pile. When a drive cap is used, hammer frame 30 rests on top of the upper surface of the drive cap. Piles typically include a consistent H-shaped or I-shaped cross-section, e.g., that extend along the length of the pile. The recess in the bottom of the drive cap is configured to mate with these cross-sections. Further, hammer 20 may include anvil 35 which is placed on top of the drive cap. Anvil 35 extends into hammer frame 30 and transmits the impact force from ram 32 into the pile.

Figure 2:
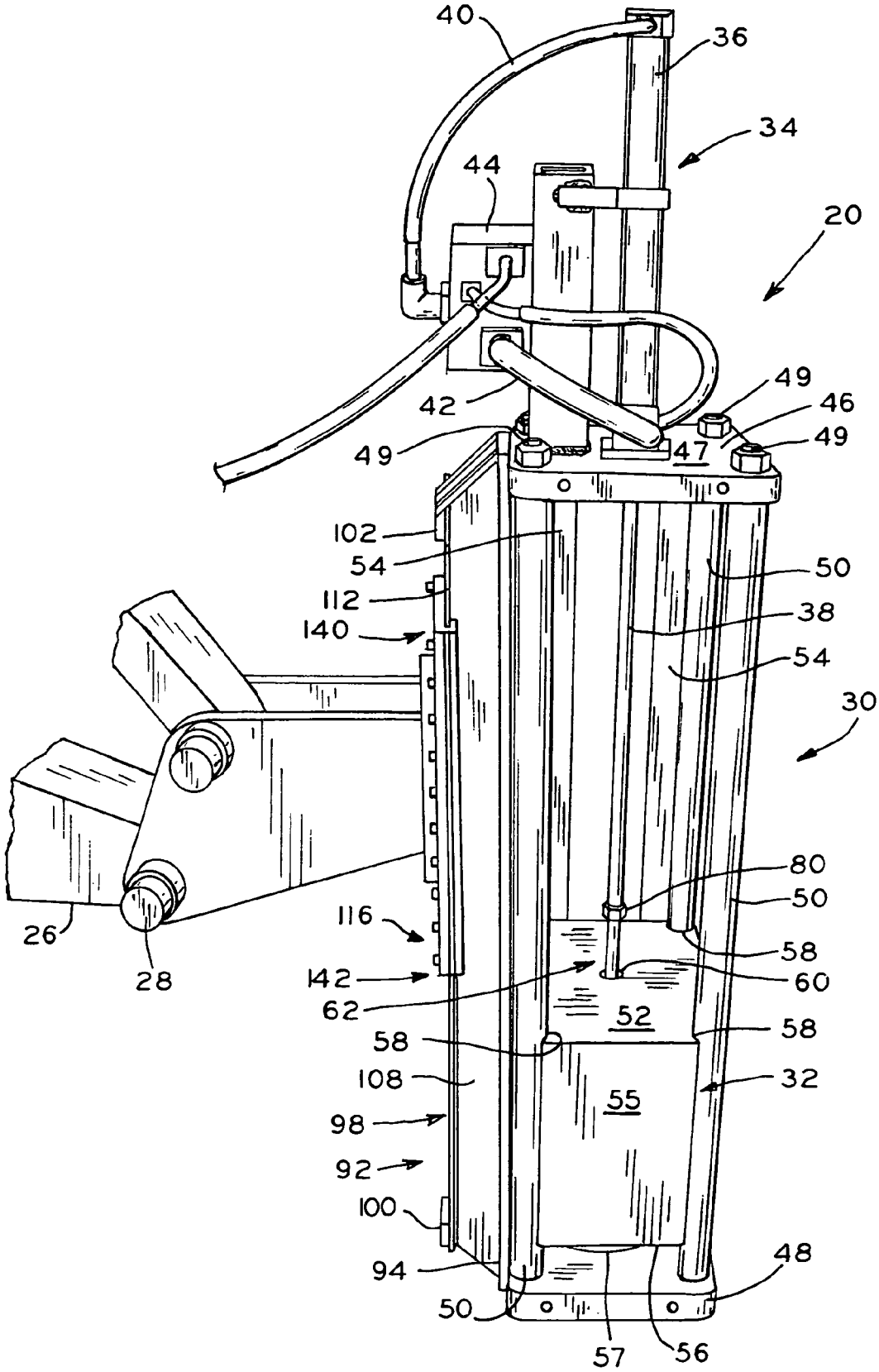
FIG. 2 is a perspective view of a hammer in accordance with the present invention.

As illustrated in FIG. 2, cylinder assembly 34 includes cylinder 36, a piston (not illustrated) positioned within cylinder 36, and cylinder rod 38 extending from the piston. In other embodiments, cylinder assembly 34 may be any other suitable type of hydraulic or pneumatic cylinder for raising and lowering the ram. In the present embodiment, fluid lines 40 and 42 are connected to cylinder 36 and co-operate to evacuate or provide pressurized fluid to cylinder 36 to move the piston therein. The flow of fluid in cylinder assembly 34 is controlled by manifold 44 which includes valves (not illustrated) to control pressurized fluid in lines 40 and 42. Referring to FIG. 2, ram 32, as illustrated, is positioned in the bottom of frame 30. To raise ram 32 to the top of frame 30, pressurized fluid enters cylinder 36 through line 42, i.e., to the rod-side of the piston, pushing the piston upward. To allow ram 32 to drop, the valves in control manifold 44 are adjusted to permit the pressurized fluid in the rod-side of cylinder 36 to rapidly escape through line 42. In some embodiments, the fluid exiting cylinder 36 through line 42 can be directed to the other side of the piston through line 40. The fluid forced to the other side of the piston through line 40 can accelerate ram 32 downwardly to increase the impact force applied to pile 22. However, in this embodiment, a majority of the ram's acceleration will result from gravity.

As illustrated in FIG. 2, frame 30 includes top plate 46, bottom plate 48, and four guideposts 50 positioned therebetween. Frame 30 further includes four cables 49 extending through passages within guideposts 50 (not illustrated) and apertures in top plate 46 and bottom plate 48 (not illustrated). Fasteners 52 are threaded to the ends of cables 49 to compress top plate 46 and bottom plate 48 to the ends of guideposts 50. Frame 30 also includes frame supports 54 (FIG. 7) extending between and fastened to top plate 46 and bottom plate 48. Top plate 46 includes several apertures (not illustrated) in top surface 47 for fastening cylinder assembly 34 thereto. Top plate 46 further includes a through-hole (not illustrated) for cylinder rod 38 to extend and translate therethrough. Bottom plate 48 includes through-hole 57 in which anvil 35 extends therethrough.

Figure 3:
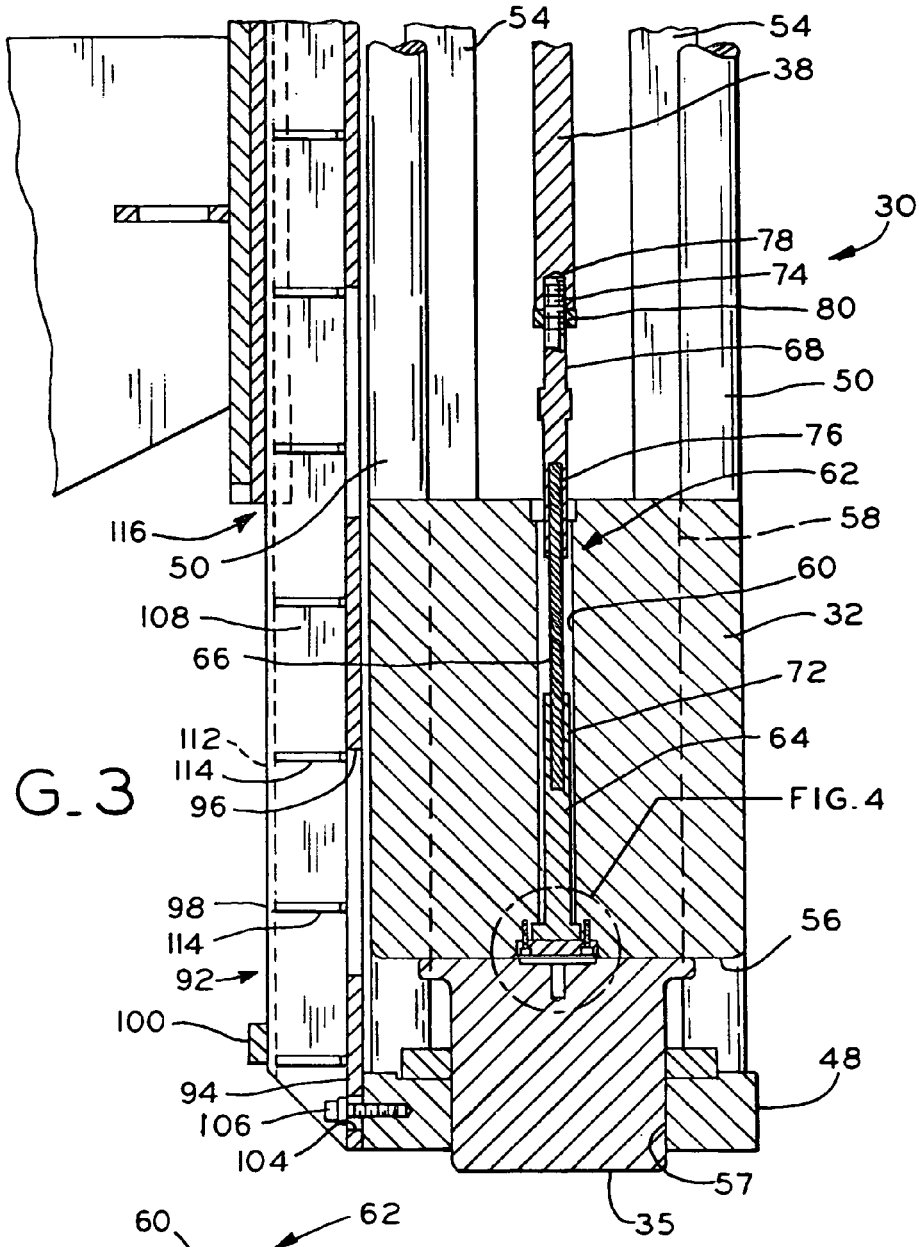
FIG. 3 is a fragmentary cross-sectional view of the hammer of FIG. 2.
Figure 4:
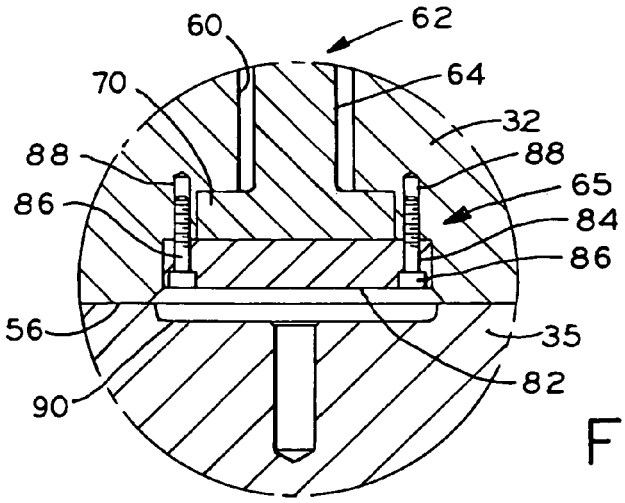
FIG. 4 is an enlarged detail view of a portion of the hammer of FIG. 3.

As illustrated in FIGS. 2-4, ram 32 is substantially rectangular and is defined by top surface 52, striking surface 56 and four side surfaces 55. Ram 32 further includes four semi-circular recesses 58 extending between top surface 52 and striking surface 56 along the edges of side surfaces 55. Ram 32 is positioned within frame 30 intermediate top plate 46, bottom plate 48 and guideposts 50. Recesses 58 are configured to closely parallel the outside surface of guideposts 50. Ram 32 is captured between guideposts 50 and can be displaced substantially parallel to guideposts 50 between top plate 46 and bottom plate 48. As ram 32 is captured intermediate guideposts 50, ram 32 cannot substantially translate transverse to guideposts 50.

Figure 5:
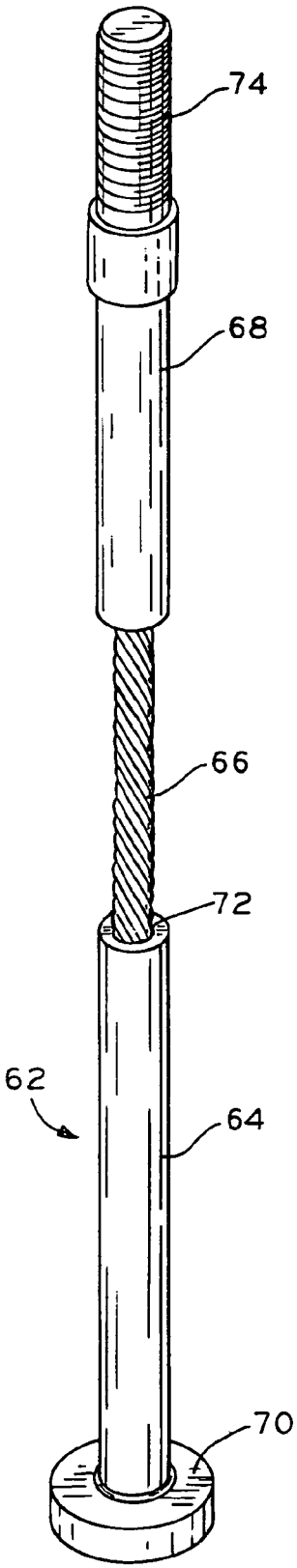
FIG. 5 is a perspective view of a connector assembly for connecting the ram of the hammer of FIG. 2 to the cylinder.
Figure 6:
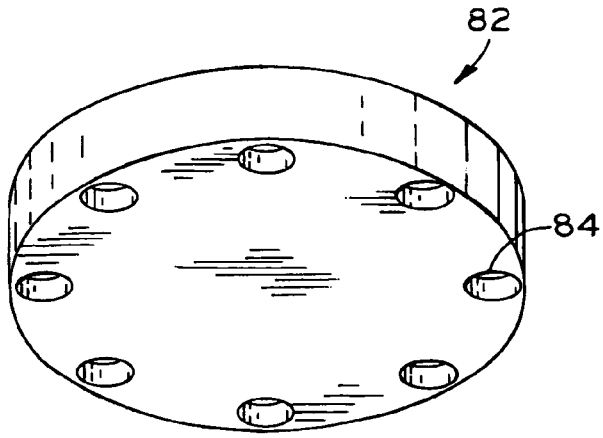
FIG. 6 is a perspective view of a retainer cap for securing the mounting apparatus of FIG. 5 to the ram.

Ram 32 further includes aperture 60 extending between top surface 52 and striking surface 56. Aperture 60 is sized to accommodate connector assembly 62. Connector assembly 62 connects cylinder rod 38 to ram 32. As illustrated in FIGS. 3-5, connector assembly 62 includes mounting shaft, or connector member, 64, cable 66 and adapter 68. Mounting shaft 64 includes an elongate body having flange 70 at one end and cable connection aperture 72 at the other end. Flange 70 is positioned within recess 65 (FIG. 4) of a bottom portion of ram 32 and cable 66 is captured within aperture 72 of mounting shaft 64. In one exemplary process, prior to attachment, the inner diameter of aperture 72 is slightly larger than the other diameter of cable 66. To assemble cable 66 and mounting shaft 64 together, one end of cable 66 is inserted into aperture 72 and, subsequently, mounting shaft 64 is compressed or crimped onto cable 66. In one exemplary process, mounting shaft 64 is crimped onto cable 66 using a series of swage dies that gradually swage and reduce the outer diameter of mounting shaft 64 and, accordingly, the inner diameter of aperture 72 onto cable 66. In the present embodiment, only the portion of mounting shaft 64 proximate the connection to cable 66 is swaged or crimped.

Cable 66 extends upward through aperture 60 of ram 32. Adapter 68 includes an elongate body having threaded end 74 and cable connection aperture 76 in the other end. Threaded end 74 is threaded into threaded aperture 78 (FIG. 3) of cylinder rod 38 and nut 80 is fastened to threaded end 74 to secure connector assembly 62 to cylinder rod 38. Cable 66 is captured within aperture 76 of adapter 68 where adapter 68 and cable 66 can be assembled together in a manner similar to the above-described method for assembling mounting shaft 64 and cable 66.

As illustrated in FIGS. 3 and 4, flange 70 of mounting shaft 64 is retained in recess 65 by retainer cap 82. In this embodiment, retainer cap 82 is substantially disk shaped and includes a plurality of fastener apertures 84. Fasteners, such as screws 86, are inserted through apertures 84 and threadingly engage threaded apertures 88 in the bottom of ram 32 to mount retainer cap 82 thereto. When secured to ram 32, retainer cap 82 preferably does not extend below striking surface 56. If retainer cap 82 were to, in fact, extend below striking surface 56, all of the driving force from the ram may be transmitted through retainer cap 82 which may cause damage thereto. However, recess 90 may be provided in anvil 35 to accommodate a retainer cap that extends from striking surface 56, thereby preventing contact solely between retainer cap 82 and anvil 35.

In operation, as discussed above, ram 32 is raised by the piston within cylinder assembly 34. More particularly, cylinder rod 38, which is mounted to the piston, pulls upwardly on adapter 68 of connector assembly 62. As a result, cable 66 is drawn taut and subsequently pulls upward on mounting shaft 64. Once cable 66 is taut, ram 32 may be lifted within frame 30, raised along the ram driving axis to a predetermined height and then released. In some embodiments, as discussed above, in addition to gravitational acceleration, ram 32 can be accelerated downwardly by reversing the flow of fluid in cylinder assembly 34. Upon impact, a substantial driving force from ram 32 is imparted to anvil 35, the drive cap, and/or pile 22. This force acts to drive pile 22 downwardly and is dissipated or absorbed, mostly, by the ground. However, in previous devices, a substantial resultant force would act upwardly through a rigid connection between the ram and the cylinder rod. This resultant force was created, in part, by the sudden deceleration of the piston and the cylinder rod rigidly connected to the top of the ram. The resultant force counteracted and decelerated the weight of the piston and the cylinder rod. In these previous designs, the resultant force often deteriorated and/or broke the rigid connection between the cylinder rod and the ram. Other designs have included a ram having a rubber or nylon pocket for housing the cylinder rod to absorb and dissipate this force, however, the rubber and nylon linings also deteriorated quickly. Additionally, in these previous designs, the resultant force was transmitted into the cylinder through the cylinder rod. More particularly, this force was transmitted from the cylinder rod to the piston attached thereto and then to the cylinder wall through the piston seals therebetween. As a result, the piston seals often quickly deteriorated causing leaks and other dysfunction of the cylinder.

In the present embodiment, ram 32 and cylinder rod 38 are not rigidly connected to each other. As a result, a smaller resultant force is transmitted to cylinder assembly 34 than in previous designs. More specifically, cable 66 is flexible and can deflect when acted upon by opposing compressive forces, such as the falling weight of the piston and cylinder rod 38 and the resultant force, at its ends. As discussed above, one end of cable 66 is attached to mounting shaft 64 which is mounted to ram 32, and the other end of cable 66 is attached to adapter 68 which is connected to cylinder rod 38. When ram 32 strikes the pile, the weight of cylinder rod 38 and the cylinder piston are not transmitted directly to ram 32. On the contrary, their weight acts through cable 66 to mounting shaft 64. However, as cable 66 is flexible, the ends of cable 66 are displaced toward each other when the axially compressive loads are applied. Cable 66 can deflect or deform in several different ways when it is compressed to absorb some of the force. In one embodiment, the individual strands comprising the cable can move relative to each other causing the sides of the cable to bulge outwardly. In another embodiment, the center portion of the cable, intermediate the two ends of the cable, can displace radially or outwardly with respect to an axis defined by the two ends of the cable. Furthermore, the cable may coil within aperture 60 of ram 32. However, in some embodiments, a cable substantially resistant to large deflections may be preferred. In effect, cable 66 can act as a shock absorber allowing the piston and cylinder rod 38 to be gradually decelerated by cable 66. Due to the gradual deceleration of the piston and cylinder rod 38, as opposed to sudden deceleration that occurs with a rigid connection, a lesser resultant force is created. Thus, typically, cable 66 does not transmit a substantial resultant force through the piston seals, thereby improving the longevity of cylinder assembly 34 and reducing the downtime and cost to replace the cylinder assembly. Additionally, in some embodiments, cable 66 may be designed to break upon extraordinary or excessive loading. In effect, cable 66 can be selected as a failure point, or failsafe, to prevent excessive loading from reaching cylinder assembly 34. This feature may be particularly advantageous when connector assembly 62 is less expensive to produce and easier to replace than cylinder assembly 34.

Figure 14:
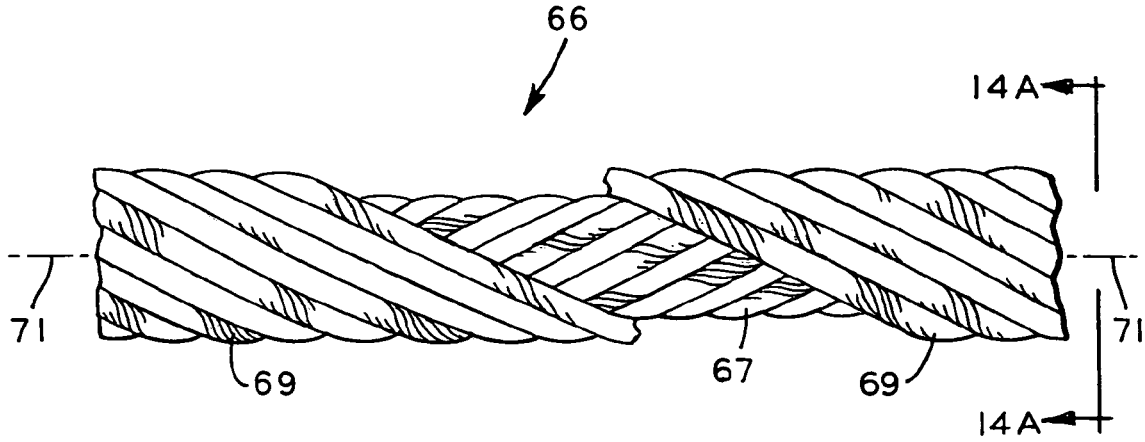
FIG. 14 is a fragmentary break-away view of the cable of the hammer of FIG. 2 having an inner core of strands and an outer layer of strands.
Figure 14A:
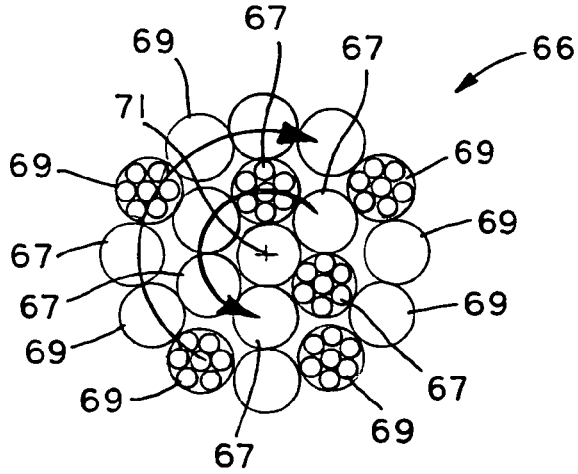
FIG. 14A is a cross-sectional view of the cable of FIG. 14 taken along line 14A-14A in FIG. 14.
Figure 15:
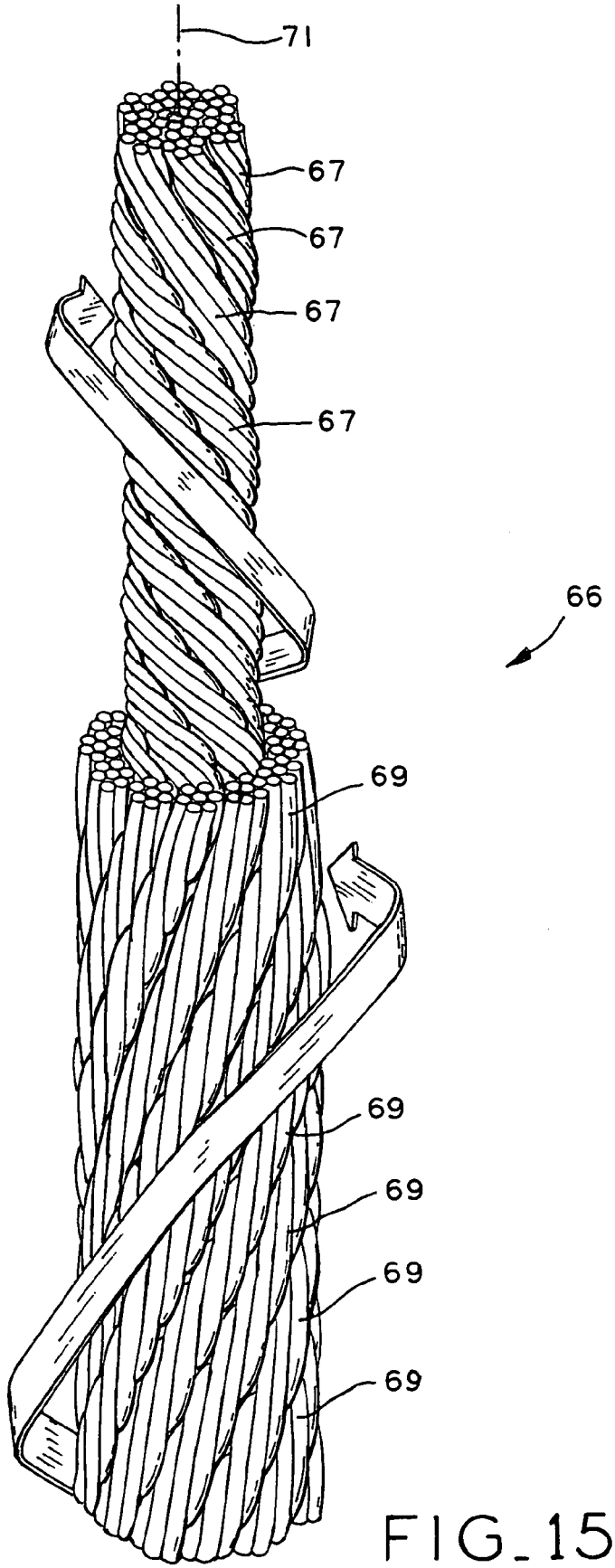
FIG. 15 is a fragmentary break-away view of an alternative embodiment of cable.

In one exemplary embodiment, referring to FIGS. 14 and 14A, cable 66 may be constructed from rotation-resistant cable, as opposed to traditional cable. Traditional cable typically comprises many smaller strands that are wrapped, or wound, together about a central axis in either a clockwise or a counter-clockwise direction. In several embodiments, each strand can be comprised of several smaller wires that are wound together to form the strand. However, when traditional cable is placed into axial compression or tension, the cable can rotate about its central axis owing to the winding pattern of the strands. More particularly, traditional cable may rotate about its central axis due to a rotational torque that is created when an axial load is applied to the cable. As a result, when traditional cable is used in connector assembly 62 discussed above, the cable may rotate the cylinder rod and the piston within the cylinder. Repeated rotation in this manner may cause premature wear of the piston seals between the piston and the cylinder wall. Rotation-resistant cable also comprises several strands that are wound together, however, this type of cable can include, in one embodiment, a central core of strands which is surrounded by an outer layer of strands that are wound about the central core where the inner core of strands is wound in one direction and the outer layer of strands is wound in the reverse direction. For example, referring to FIGS. 14 and 14A, the strands of inner core 67 can be wound in a counter-clockwise direction about axis 71 and the strands of outer layer 69 can be wound in a clockwise direction about axis 71. As a result, when cable 66 is subjected to either a compressive or tensile load, the rotational torques created by the windings inner core 67 and outer layer 69 substantially counteract each other and, as a result, cable 66 does not substantially rotate about axis 71. In an alternative embodiment, illustrated in FIG. 15, the strands of inner core 67 are wound in a clockwise direction about axis 71 and the strands of outer layer 69 are wound in a clockwise direction about axis 71. In a further embodiment, cable 66 may include several layers of strands wrapped in clockwise and/or counter-clockwise directions, with or without a central core. In this embodiment, at least one layer is wrapped in one direction and at least one layer is wrapped in another direction. However, it is contemplated that either traditional or rotation-resistant cable may be utilized in the embodiments described herein. These cables may be made from any suitable material sufficient to achieve the aims and goals described herein, including steel. Further, cables 49 discussed above may be either traditional or rotation-resistant cable.

Figure 7:
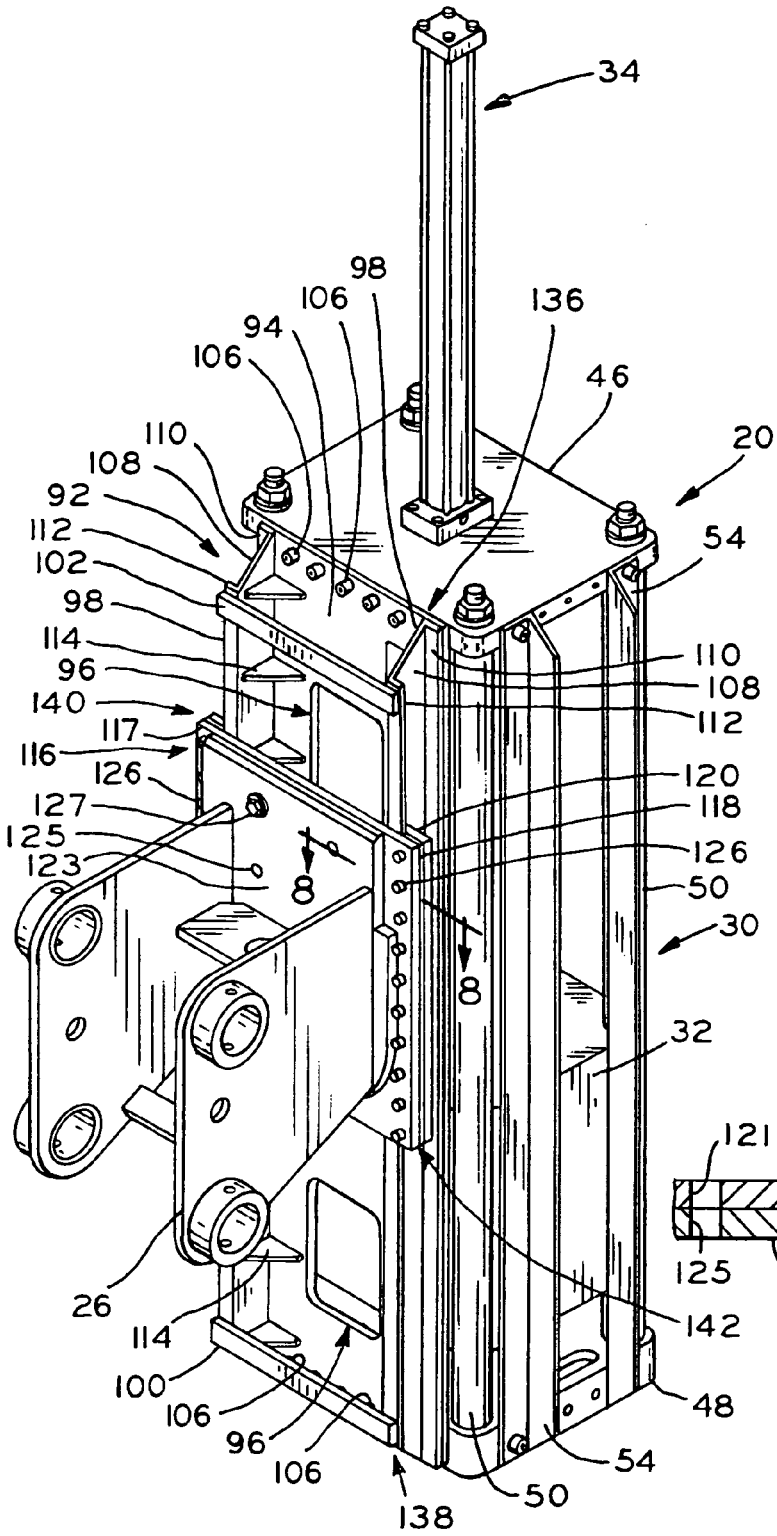
FIG. 7 is a perspective view of the hammer of FIG. 2 illustrating frame rails mounted to the hammer frame engaged with a mounting plate assembly mounted to the boom of the excavator.

As illustrated in FIGS. 3 and 7, hammer 20 further includes frame rail assembly 92 fastened to frame 30. Frame rail assembly 92 includes, as illustrated in FIGS. 2, 3, and 7-9, flat plate 94, frame rails 98 and travel stops 100 and 102. Flat plate 94 includes windows 96 which allow ram 32 to be viewed from the rear whereas a solid plate would obstruct such a view. Plate 94 further includes apertures 104 for fastening assembly 92 to frame 30 with fasteners 106. In this embodiment, frame rails 98, which include elongate C-channels, are welded to plate 94. Each C-channel includes an elongate base portion 108 having a joining flange 110 and a mounting flange 112 extending therefrom on opposite side edges thereof. In this embodiment, frame rails 98 are positioned on plate 94 such that the elongate axes of the C-channels are substantially parallel with guideposts 50. Also, in this embodiment, frame rails 98 are oriented such that the openings in the C-channels, and the flanges, face away from each other. Each joining flange 110 is welded to plate 94 such that frame rails 98 are rigidly affixed thereto. To further support rails 98, gussets 114 are welded to the backsides of base portions 108 and plate 94 to buttress the C-channels.

Figure 8:
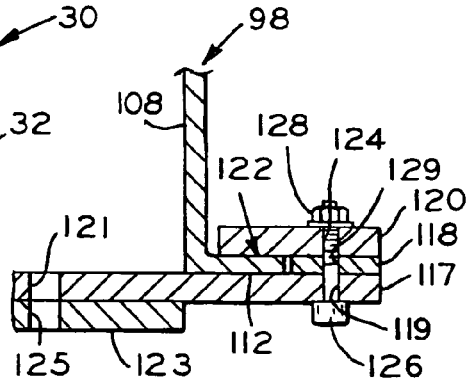
FIG. 8 is an enlarged, fragmentary cross-sectional view of the hammer illustrated in FIG. 7 taken along line 8-8 in FIG. 7.

As illustrated in FIGS. 2, 3, and 7-9, mounting plate assembly 116 is fastened to boom 26 and includes base plate 117 having a first set of apertures 121 positioned in the middle of base plate 117 for fastening assembly 116 to plate 123 of boom 26. Boom plate 123 includes a set of apertures 125 which align with apertures 121 of mounting assembly 116 when fasteners 127 are inserted therethrough. Nuts (not illustrated) are threaded to fasteners 127 to fasten plates 117 and 123 together. Plate 117 further includes a second set of apertures 119 (FIG. 8) for mounting spacers 118 and capturing plates 120 thereto. As illustrated in FIG. 8, spacers 118 and capturing plates 120 include apertures 129 and 124, respectively, that align with apertures 119 of plate 117 when fasteners 126 are inserted therethrough. Plate 117, spacers 118 and capturing plates 120 are fastened together when nuts 128 are threaded onto fasteners 126 and tightened against plates 120. As illustrated in FIG. 8, in this embodiment, capturing plates 120 extend inwardly and overhang from spacers 118 to create channels 122.

In another exemplary embodiment (not shown), mounting rails 112, and the openings of the C-channels may face toward each other defining a recess or gap therebetween. In this embodiment, the mounting plate apparatus includes a T-shaped member extending from plate 117. The T-shaped member includes an elongate member attached to and extending from plate 117 and two projections extending from the opposite end of the elongate member. The elongate member extends through the gap between mounting rails 112 where each projection fits, and is captured, between a joining rail 110 and a mounting rail 112.

To assemble mounting plate assembly 116 to frame rail assembly 92, channels 122 of assembly 116 are aligned with mounting flanges 120 of rail assembly 92 at either top end 136 of frame rails 98 or bottom end 138. Subsequently, plate assembly 116 is slid along rails 98 to engage plate assembly 116 with rail assembly 92. Travel stops 100 and 102 are joined to frame rails 98 to capture plate assembly 116 therebetween. As a result, plate assembly 116 is free to slide up and down along rails 98 but cannot be readily disassembled from hammer 20 due to stops 100 and 102. For the purposes of the present application, the terms "sliding" and "slidable" encompass not only direct sliding of one surface on another but also the use of fixed or rolling bearings, for example, between frame rail assembly 92 and mounting plate assembly 116.

Figure 9:
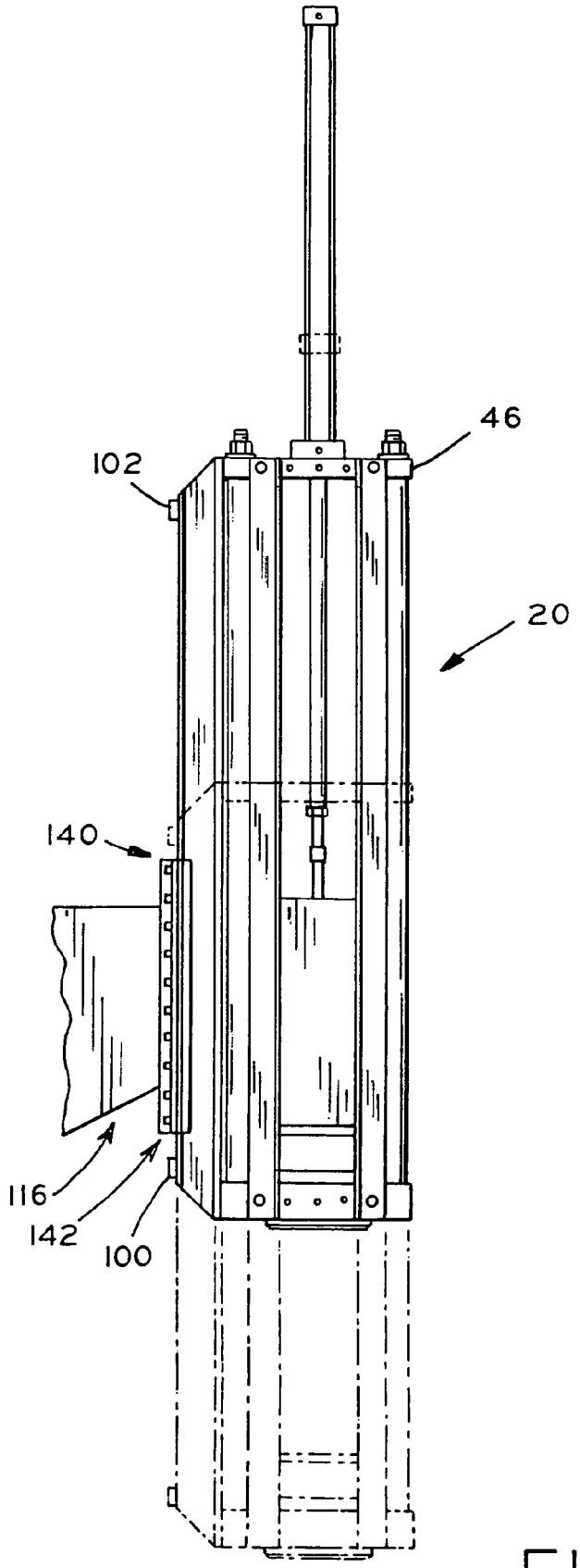
FIG. 9 is an elevation view of the hammer of FIG. 2 illustrating relative movement between the hammer and the boom of the excavator.

As hammer 20 is lifted by excavator, or pile driver, 24, hammer 20 will slide downwardly alone an axis parallel to the ram driving axis in an unrestrained manner under the influence of gravity with respect to mounting plate assembly 116 until upper stop 102 abuts top portion 140 of mounting plate assembly 116. When hammer 20 is positioned over the top of a pile, such as pile 22, frame 30 is rested on the pile or a drive cap placed on top of the pile, as discussed above. Subsequently, boom 26 is lowered downwardly with respect to hammer 20 until bottom portion 142 of mounting plate assembly 116 is proximate stop 100, as illustrated in FIG. 9. At this point, pile 22 is driven gradually into the ground through repeated strikes from ram 32, as discussed above. As frame 30 of hammer 20 is resting on pile 22, it rides downwardly with pile 22 while boom 26 remains in a substantially constant position. As pile 22 is driven into the ground, top portion 140 of mounting plate assembly 116 will gradually approach stop 102 owing to the relative movement between the hammer and the boom. When top portion 140 is proximate stop 102, boom 26, and mounting plate assembly 116, can be moved downwardly until bottom portion 142 is again proximate bottom stop 100. Notably, as boom 26 is re-adjusted downwardly, ram 32 can continue to drive pile 22 into the ground without pausing for the boom to be readjusted. This cycle is repeated as often as necessary until pile 22 is driven to a desired depth. The range of relative motion of hammer 20 with respect to mounting plate assembly 116, in this embodiment, is illustrated in FIG. 9. In one embodiment, the hammer can travel downwardly approximately three feet before the boom must be readjusted.

In another embodiment, the top of the mounting plate assembly 116 does not extend above cylinder assembly 34 giving hammer 20 a substantially low vertical profile. Due to the low vertical profile, the hammer of this embodiment may be used indoors or in other applications with relatively little overhead space. In another embodiment, the top of mounting plate 116 does not extend above top plate 46 and the bottom of mounting plate 116 does not extend below bottom plate 48. In fact, in other embodiments, it may be preferable to minimize the size of the mounting plate 116 as much as possible laterally and vertically.

Figure 10:
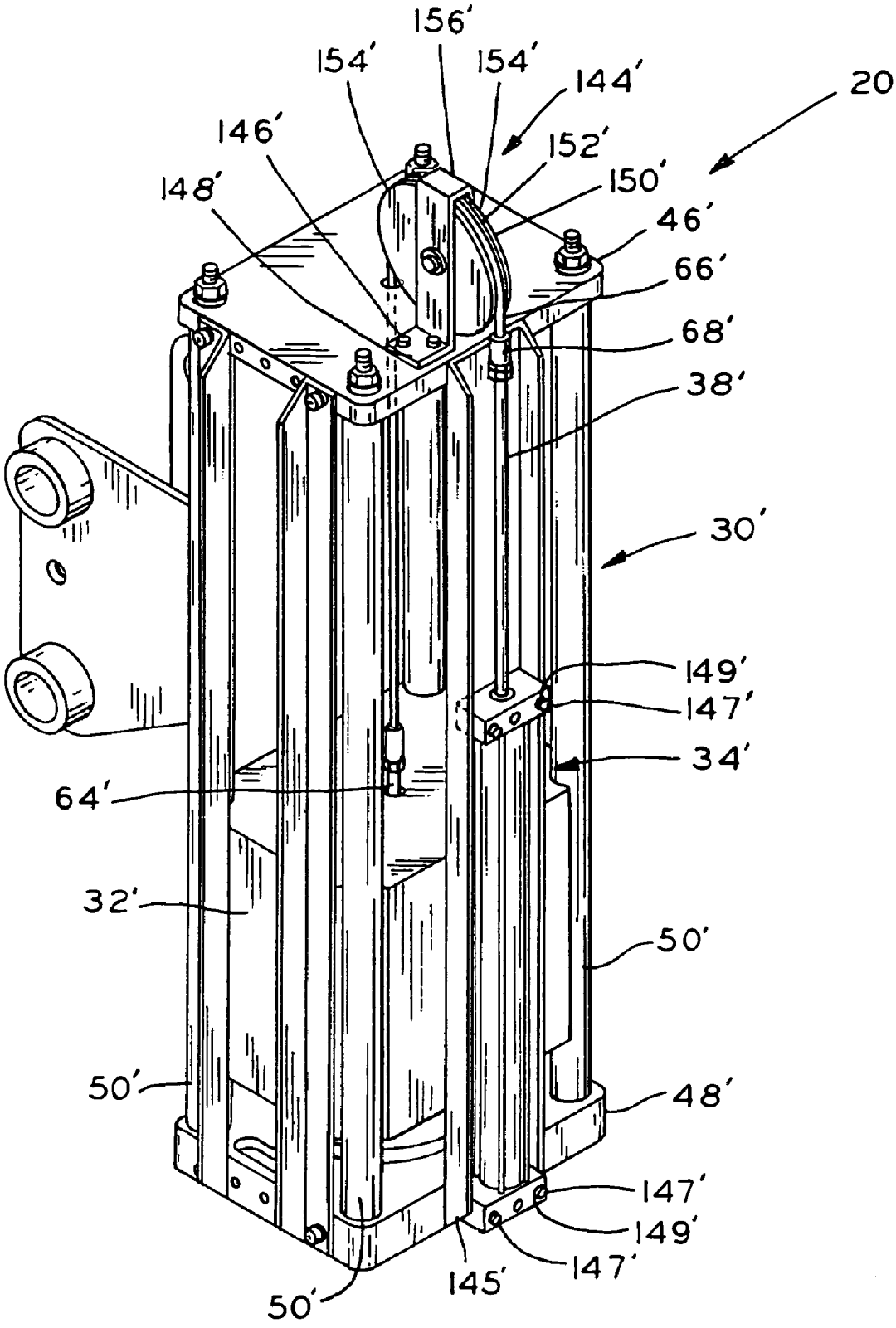
FIG. 10 is a perspective view of an alternative embodiment of the present invention including a cylinder mounted to the side of a hammer frame.

In another contemplated embodiment, as illustrated in FIG. 10, cylinder assembly 34' may be affixed the side of hammer frame 30' to reduce the vertical profile of hammer 20'. In this embodiment, cylinder assembly 34' is mounted so that cylinder rod 38' extends upwardly, as opposed to downwardly as illustrated in FIGS. 1-9, and substantially parallel to guideposts 50'. Plate 145' may be affixed to frame 30' to serve as a mount for cylinder assembly 34'. In this embodiment, fasteners 147' pass through apertures 149' in cylinder assembly 34' and fasten to apertures in plate 145' (not illustrated), and if necessary, apertures in top plate 46' and bottom plate 48'. Pulley assembly, or sheave assembly, 144' may be affixed to the top of frame 30' on top plate 46' with fasteners 146' passing through apertures (not illustrated) in mounts 148' and apertures (not illustrated) in top plate 46'. Pulley assembly 144' transfers the substantially vertical motion of cylinder rod 38' outside of frame 30' to a substantially vertical motion of ram 32' centered between guideposts 50'. Pulley assembly 144' includes substantially disc-shaped wheel 150' having recess, or groove, 152' positioned intermediate annular ridges 154' extending from the perimeter of wheel 150'. Cable 66', which extends between adapter 68' affixed to cylinder 38' and mounting shaft 64' mounted to ram 32', is guided by, and substantially captured within, recess 152'. Pulley assembly 144' may further include cable guard 156' to prevent cable 66' from unintentionally lifting out of recess 152'. In this embodiment, cable guard 156' is integral with mounts 148', as illustrated in FIG. 10.

Figure 11:
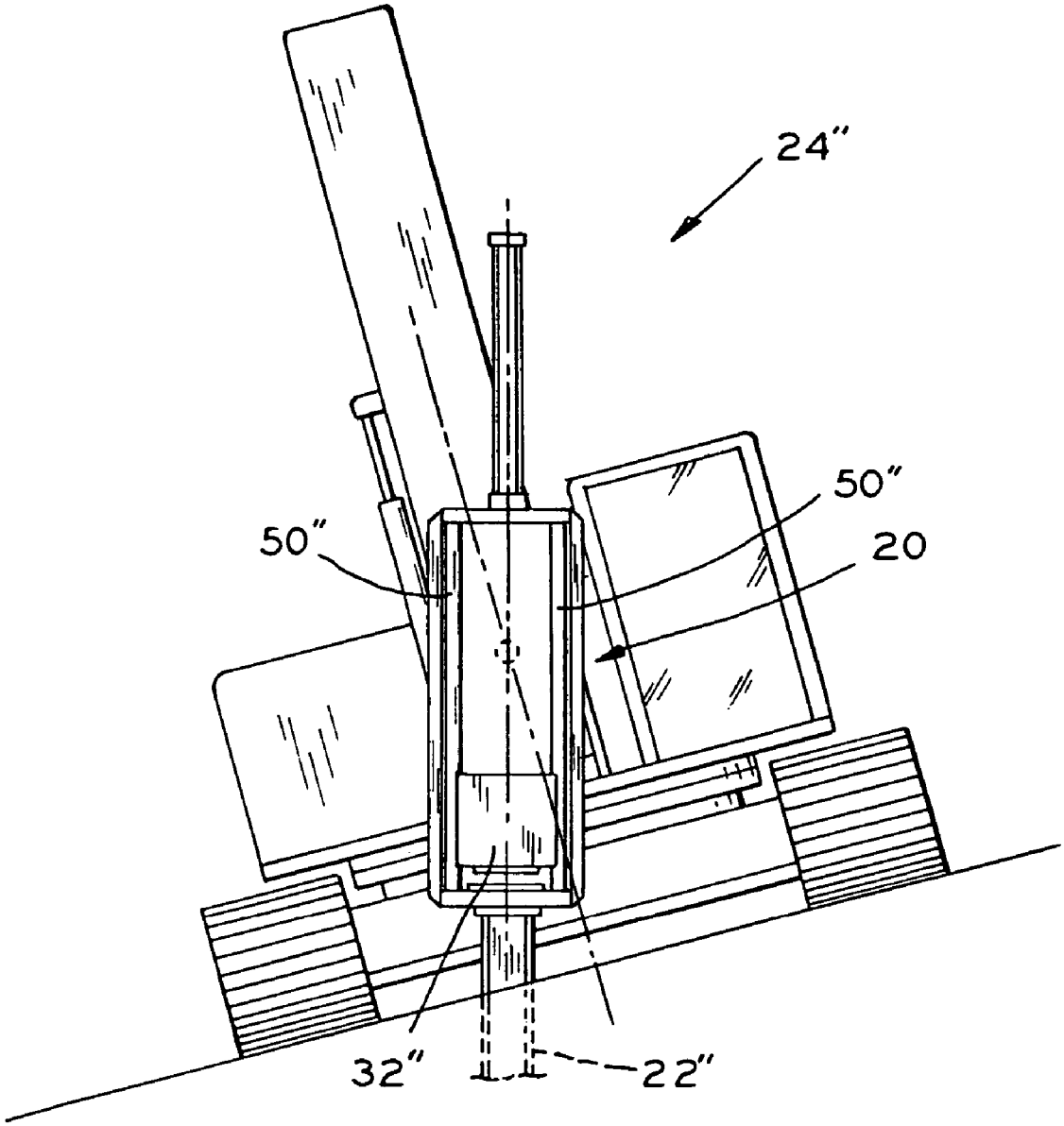
FIG. 11 is a front elevation view of an alternative embodiment of the present invention attached to an excavator positioned on an inclined surface.
Figure 12:
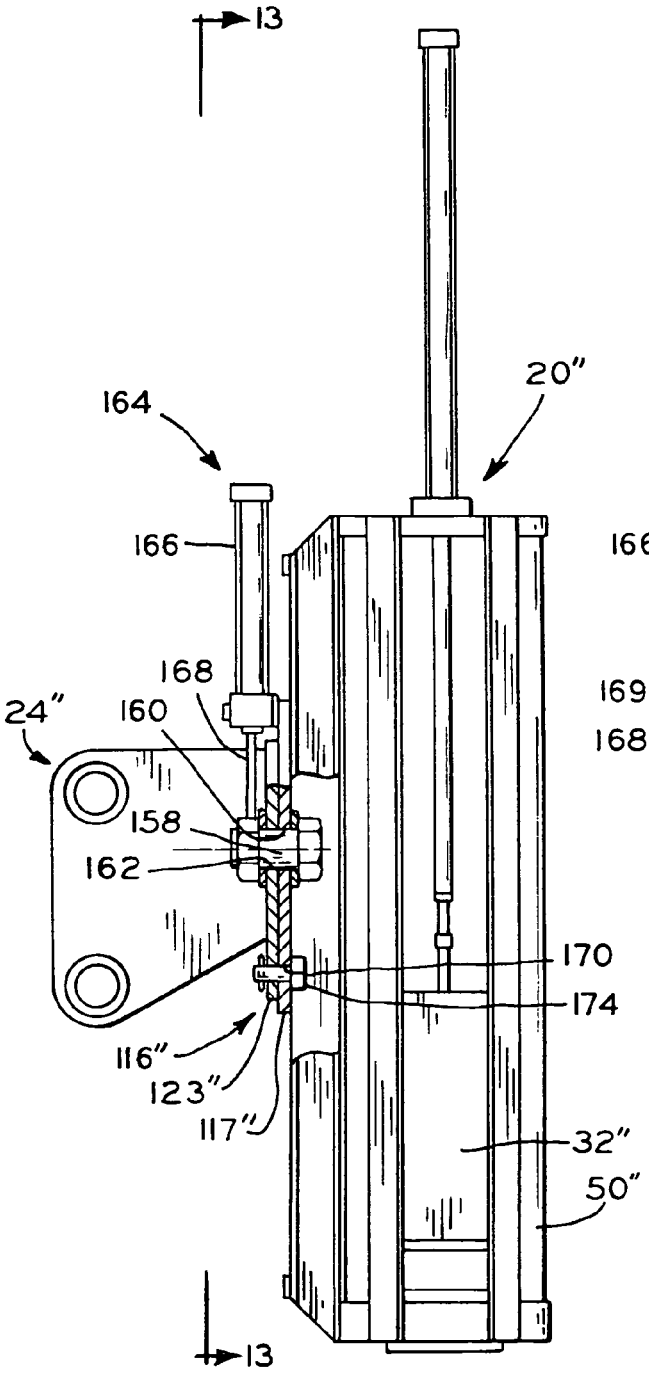
FIG. 12 is a side elevation view of the hammer of FIG. 11.
Figure 13:
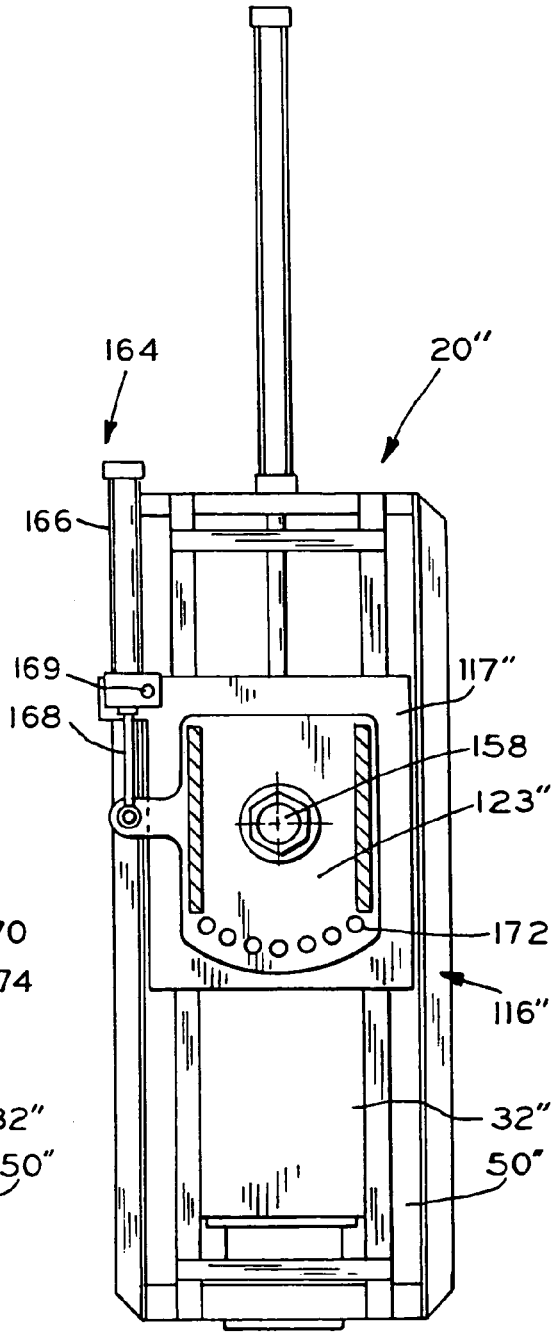
FIG. 13 is a rear elevation view of the hammer of FIG. 11.

As illustrated in FIG. 11, in some applications, excavator, or pile driver, 24" may be positioned on an incline. However, as piles are typically driven vertically downward, it is often preferable to orient hammer 20" such that the travel of ram 32" is also vertical. If hammer 20", and the travel axis of ram 32", are not oriented vertically, ram 32" may strike pile 22 at an angle. As a result, the pile may not be driven straight into the ground. Further, in a non-vertically oriented position, ram 32" may bear against guideposts 50". As a result, a large frictional force may resist movement between ram 32" and guideposts 50". In an alternative embodiment, illustrated in FIGS. 11-13, hammer 20" can rotate or pivot with respect to the boom of an excavator. To this end, hammer 20" includes pivot pin 158 that is perpendicular to the ram driving axis (see FIGS. 11-13). Pivot pin 158 connects base plate 117" of mounting plate assembly 116" to boom plate 123" of excavator 24" in lieu of the plurality of fasteners, such as fasteners 127, used to mount hammer 20 to boom plate 123 in the embodiment illustrated in FIGS. 1-9. In the present embodiment, pivot pin 158 extends through pin joint aperture 160 of base plate 117" and pin joint aperture 162 of boom plate 123". Pivot pin 158, and apertures 160 and 162, are substantially cylindrical which facilitates the relative rotational movement therebetween.

Hammer 20" may be rotated relative to the boom of the excavator manually or by cylinder assembly 164. Cylinder assembly 164 includes cylinder 166, a piston (not illustrated) positioned within cylinder 166, and cylinder rod 168 mounted to the piston. In the present embodiment, cylinder 166 is mounted to base plate 117" and the distal end of cylinder rod 168 is mounted to boom plate 123". In other embodiments, cylinder 166 is mounted to boom plate 123" and the distal end of cylinder rod 168 is mounted to base plate 117". To create relative rotational motion between hammer 20" and the boom, cylinder rod 168 is extended or retracted relative to cylinder 166. Notably, cylinder rod 168, in this embodiment, moves along a linear path, however, this linear motion is converted to relative rotational motion between plates 117" and 123" about pivot pin 158. To accommodate the conversion of the linear motion of cylinder rod 168 to the arcuate relative motion between plates 117" and 123", cylinder 166 is mounted to plate 117" via pin 169. As a result, cylinder assembly 164 can rotate about pin 169. Similar to the cylinder assembly described above, pressurized fluid enters and exits the opposite sides of the piston to move the piston within cylinder 166 and thereby move cylinder rod 168 attached thereto. Cylinder assembly 164 may be pneumatic, hydraulic, or any other suitable type of cylinder capable of performing the above functions.

Once positioned, hammer 20" can be locked into place relative to the boom. To this end, in this embodiment, base plate 117" includes aperture 170 (FIG. 12) and boom plate 123" includes a plurality of apertures 172 positioned radially and substantially equidistant to pin joint aperture 162. To lock the position of hammer 20" relative to the boom, hammer 20" is rotated into an orientation where aperture 170 of base plate 117 substantially aligns with one of apertures 172. Subsequently, lockpin 174 is inserted into aperture 170 and one of apertures 172 to prevent substantial relative movement between base plate 117" and boom plate 123". When it is desirable to once again rotate hammer 20" relative to the boom, lockpin 174 is removed. In other embodiments, base plate 117" includes a plurality of apertures while boom plate 123" includes a single aperture. In yet other embodiments, both base plate 117" and boom plate 123" include a plurality of apertures. Locking the rotational position of mounting plate assembly 166 in this way provides the advantage of preventing hammer 20" from becoming misoriented during operation. To prevent gross misorientations between mounting plate assembly 166 and the boom, mechanical stops may be provided on, e.g., either plate 117" or 123".

While this invention has been described as having exemplary designs, the present invention may be further modified within the spirit and scope of this disclosure. Therefore, this application is intended to cover any variations, uses, or adaptations of the invention using its general principles. Further, this application is intended to cover such departures from the present disclosure as come within known or customary practice in the art to which this invention pertains.

We claim:

1. A pile driver hammer, comprising:

a frame;

a ram disposed on said frame and movable along a ram driving axis with respect to said frame;

a ram lifting mechanism supported by said frame and connected to said ram; and a mounting assembly including a first portion and a second portion, said first portion connected to said frame, said second portion adapted to be connected to a boom, said first portion being freely slidably connected to said second portion in an unrestrained manner along an axis parallel to the ram driving axis whereby said frame can be placed on top of a pile and follow the pile downwardly under the force of gravity relative to the boom as the pile is driven into the ground.

2. The pile driver hammer of claim 1, wherein said first portion includes at least one frame rail mounted to said frame and said second portion includes a mounting assembly adapted to be mounted to a boom, and wherein said at least one frame rail and said mounting assembly are engaged to permit slidable movement therebetween.

3. The pile driver hammer of claim 2, wherein said frame includes a top and a bottom, and wherein said mounting assembly does not extend above said top of said frame in its uppermost position, whereby said hammer may be used in applications having very little overhead room.

4. The pile driver hammer of claim 2, wherein said frame includes a top and a bottom, and wherein said mounting assembly does not extend below said bottom of said frame in its lowermost position.

5. The pile driver hammer of claim 2, wherein said mounting assembly further includes a mechanism for enabling said first portion to rotate with respect to said second portion.

6. The pile driver hammer of claim 5, wherein said mounting assembly includes at least one first aperture and at least one second aperture, and wherein said mounting assembly further includes a lockpin removably inserted into one of said at least one first aperture and one of said at least one second aperture to prevent said first portion from substantially rotating with respect to said second portion.

7. The pile driver hammer of claim 1, wherein said first portion is also relatively rotatable with respect to said second portion about an axis that is substantially perpendicular to the ram driving axis.

8. The pile driver hammer of claim 7, wherein said second portion includes a mounting assembly that includes a pivot pin to allow said first portion to rotate relative to said second portion.

9. The pile driver hammer of claim 1, wherein said first portion includes at least one frame rail mounted to said frame and said second portion includes a base plate, wherein said base plate is slidable with respect to said at least one frame rail, wherein said second portion further includes a mounting plate adapted to be mounted to a boom, and wherein said base plate is rotatable with respect to said mounting plate about an axis that is substantially perpendicular to the ram driving axis.

10. The pile driver hammer of claim 1, wherein said ram lifting mechanism comprises a hydraulic cylinder mounted to said frame.

11. The pile driver hammer of claim 10, wherein said ram lifting mechanism further comprises a cable connecting said hydraulic cylinder and said ram.

* * * * *